United States Patent [19]

Mahaffy et al.

[11] 4,308,711

[45] Jan. 5, 1982

[54] PACKAGING APPARATUS AND TECHNIQUES FOR FORMING CLOSURE-TOPS

[75] Inventors: Reid A. Mahaffy, Montclair; Walter A. Mainberger, Wayne, both of N.J.

[73] Assignee: Mahaffy & Harder Engineering Co., Totowa, N.J.

[21] Appl. No.: 83,370

[22] Filed: Oct. 10, 1979

Related U.S. Application Data

[60] Division of Ser. No. 971,997, Dec. 21, 1978, Pat. No. 4,201,030, which is a continuation of Ser. No. 822,088, Aug. 5, 1977, abandoned.

[51] Int. Cl.[3] ..... B65B 31/02

[52] U.S. Cl. ..... 53/511

[58] Field of Search ..... 53/510, 511, 559, 388

[56] References Cited

U.S. PATENT DOCUMENTS

| | | | |
|---|---|---|---|
| 2,915,867 | 12/1959 | Frank et al. | 53/388 X |
| 3,186,142 | 6/1965 | Borgardt et al. | 53/388 X |
| 3,659,393 | 5/1972 | Richter | 53/511 X |
| 3,744,210 | 7/1973 | O'Lenick et al. | 53/511 X |
| 3,792,181 | 2/1974 | Mahaffy et al. | 53/511 X |

*Primary Examiner*—Robert D. Baldwin

*Attorney, Agent, or Firm*—Parmelee, Johnson, Bollinger & Bramblett

[57] ABSTRACT

Packaging apparatus for making vacuum or gas-filled packages of the type including a flanged cup-shaped receptacle with a closure film sealed to the flanges and stretched down into the cup to engage and press against the product. The apparatus comprises a first packaging station where the film is sealed to the cup flanges part way around the cup mouth; simultaneously the film is heated in pre-selected locations to soften it for subsequent stretching. In a subsequent station, the partially-completed package is placed in a vacuum chamber and evacuated. Thereafter, a plug is driven against the still heated film, to force it down into the cup interior adjacent the product. Before or after the plug movement, the film is fully sealed to the cup, to make a hermetically-sealed package. While the plug holds the film in its stretched condition, the spaces outside of the film are vented to apply fluid pressure to the film, to cause the film to conform closely to the product shape, and to match closely the contour of the cup.

3 Claims, 11 Drawing Figures

PACKAGING APPARATUS AND TECHNIQUES FOR FORMING CLOSURE-TOPS

This is a division of application Ser. No. 971,997 filed Dec. 21, 1978, now U.S. Pat. No. 4,201,030 issued May 6, 1980, which in turn is a continuation of Ser. No. 822,088 filed Aug. 5, 1977, now abandoned.

BACKGROUND OF THE INVENTION

1. Field of the Invention

This invention relates to packaging techniques and especially to techniques for making vacuum or gas-filled packages such as those used to contain food products. In one important aspect, this invention relates to improved packaging apparatus adapted to form top closures which conform substantially to the shape of the product surface. The disclosed apparatus moreover advantageously can make a variety of different kinds of packages with only minimal alteration of the equipment to change over from one type of package to another.

2. Description of the Prior Art

Various kinds of packaging machines have been proposed and used over the years. Commonly the automatic packaging machines in commercial use make vacuum packages from two continuous webs of plastic film supplied as rollstock, one web being formed into cup-like containers with flanges around the mouth, the other serving to provide top closures which are sealed to the cup flanges. Typically, the lower web is first thermoformed into successive container cups, and thereafter the cups are advanced together with the upper web through one or more packaging stations where (1) the top is sealed to the cup part-way around its periphery while leaving an evacuation opening, (2) the package is evacuated through the opening, and (3) the evacuation opening is closed off to completely seal the package from atmosphere.

For certain types of packages, especially those made with receptacle cups of semi-rigid material where the upper product surface is below the plane of the cup flanges, it is desirable to stretch-form the top material so that it fits into the cup, somewhat in telescoping fashion, to engage the product surface and thereby permit the product to carry the stress load of atmospheric pressure. There are various ways in which such formed tops have been made, as described hereinbelow.

In one packaging machine, shown in U.S. Pat. No. 3,545,163 issued to R. A. Mahaffy, et al, semi-rigid cups formed in the lower web of plastic film move through three successive packaging stations together with the upper web. In the first station, an "initial" or partial seal is made between the upper web and the peripheral flange around the mouth of each corresponding cup; at the same time, heat is transferred to a part of the upper web inboard of the seal line, to soften the plastic for subsequent stretch-forming. In the second station, the heat-softened portions of the upper web are stretched upwardly, away from the cup, to make a top having the appearance somewhat of an upside-down cup, and having a depth approximately equal to the distance between the flange plane of the product-containing cup and the upper surfaces of the product in the cup; the second station also included means to chill the stretch-formed upper web while held in its stretched condition, thereby to prevent shrink-back of the plastic. The formed webs then are shifted to the third station where the formed top is inverted and forced down into the product cup to be pressed against the top surface of the product; also at this station, the package is evacuated, and a final seal made at the evacuation opening.

It will be clear that the shape of the formed top in the apparatus described above is effectively controlled by the top-forming recess in the second station. When used with products having a relatively flat surface, such as sliced luncheon meats, a top formed in such apparatus can provide reasonably close conformity to the product shape, especially when the top material is thin and flexible. However, where the top web is relatively thick and/or stiff, e.g. semi-rigid plastic, or where the top contour of the product is substantially irregular, it is not readily possible to obtain the desired excellent conformity between the top and the product surface. The machine described above also is not well adapted for ready interchangeability between different product types, since it uses a series of trays to carry the semi-rigid cups through the packaging sequences, and such trays cannot easily be altered to suit various product types.

U.S. Pat. No. 3,805,486 shows a later machine which also uses the technique of forming the top in a station preceding the evacuation-and-final-seal station. In this machine, the top is formed from the lower web of (flexible) plastic, and the product is placed on the formed top prior to its assembly to the cup formed in this case from the upper web. The lower web is conveyed through the operating stations by edge clamps rather than by trays as in the previously-described machine.

In another machine, shown in U.S. Pat. No. 3,695,900, the top is formed in the final-seal station. The preceding station serves the usual initial-seal function, and also provides for transfer of heat to the upper web to prepare it for subsequent stretch-forming. The final-seal station includes the usual vacuum chamber which serves to evacuate the package prior to making the final seal. When the vacuum chamber is vented, atmospheric pressure will force the heated top web down against the product. In this manner, the upper web of the package can be made to conform somewhat to the product profile.

However, the arrangement described in that patent is not fully satisfactory for a variety of product types. In particular, the heated plastic of the top may shrink back to set up stresses in the package tending in certain applications to physically distort the package, e.g. especially with semi-rigid container cups of only moderate thickness or stiffness. Moreover, since the force which presses the top down against the product is proportional to the difference between atmospheric pressure and the pressure in the package, it will be evident that the top-forming technique disclosed in this patent is not well suited for use in making gas-filled packages. Still another limitation with this technique is that it sometimes has a tendency to produce thinning-out or puncturing of the plastic in the regions where stretch-forming is effected.

U.S. Pat. No. 3,972,155 shows another top-forming arrangement wherein the top formation takes place in the final-seal-and-evacuation station. FIGS. 4 and 6 of that patent show the use of a plug fixed to the roof of the vacuum chamber, to press down against the film while the chamber is being closed prior to evacuation of the package. Subsequent venting of the chamber applies pressure to the top web to force that web down towards the product.

It also is known in the art to pre-form the top closure in a separate operation, to apply such formed top to the container cup in an evacuation chamber, and then vent the chamber. Although this approach has been effective for certain applications, it requires very close product control and tooling for each individual package shape, since all of the elements (i.e. the receptacle cup, the product, and the formed top) must fit exactly, in a custom-tailored arrangement for each particular product. Thus this method is costly to carry out, because of its close tolerance requirements, and also lacks versatility since each product shape must have its own unique tooling.

SUMMARY OF THE INVENTION

It is a principal object of this invention to provide improved techniques and apparatus for forming the top closure of a vacuum or gas-filled package, so as to avoid or minimize the disadvantages of the prior art such as discussed above. A related object of the invention is to provide economical apparatus which can flexibly be used to package a variety of different products, without requiring extensive changeover modifications.

In a preferred embodiment of the invention, to be described hereinbelow in detail, two continuous plastic webs (the lower one formed into cups) are carried by an intermittently-indexed edge-clamp conveyor through two successive packaging stations. In the first or initial seal station, the upper web is sealed to the associated cup around substantially the entire peripheral flange thereof, leaving an unsealed region adjacent an evacuation slit previously cut in the lower web; simultaneously, the upper web is selectively heated in regions which are subsequently to be stretch-formed. In the second or final seal station, the package is placed in a vacuum chamber and evacuated through the evacuation slit. After the start of evacuation, a plug, shaped to match the package top, is driven down against the upper web to force the previously heated and still soft and formable top closure downward into the receptacle, stretching the film towards the product, preferably to the surface of the product. Thereafter, the evacuation slit is sealed off to complete the final seal of the package, and the upper part of the vacuum chamber is vented, advantageously to a pressure higher than atmospheric.

It has been found that, in the machine to be described, the composite of forces acting on the top closure will form the top film closely into conformity with the surface of the product, even though the product shape be substantially irregular. Moreover, the top film will be forced tightly into any depressions or pockets in the package interior. The result is a package with minimal distorting stresses or voids, and a completely encased and immobilized product with sharp definition of contours, providing a superior appearance.

Other objects, aspects and advantages of the invention will in part be pointed out in, and in part apparent from, the following description of preferred embodiments, considered together with the accompanying drawings.

DESCRIPTION OF THE DRAWINGS

FIGS. 1 through 8 illustrate packaging apparatus in accordance with this invention used for the packaging of round sliced luncheon meat. FIG. 9 shows a modified arrangement used for packaging frankfurters.

DETAILED DESCRIPTION OF PREFERRED EMBODIMENTS

Figure 1:
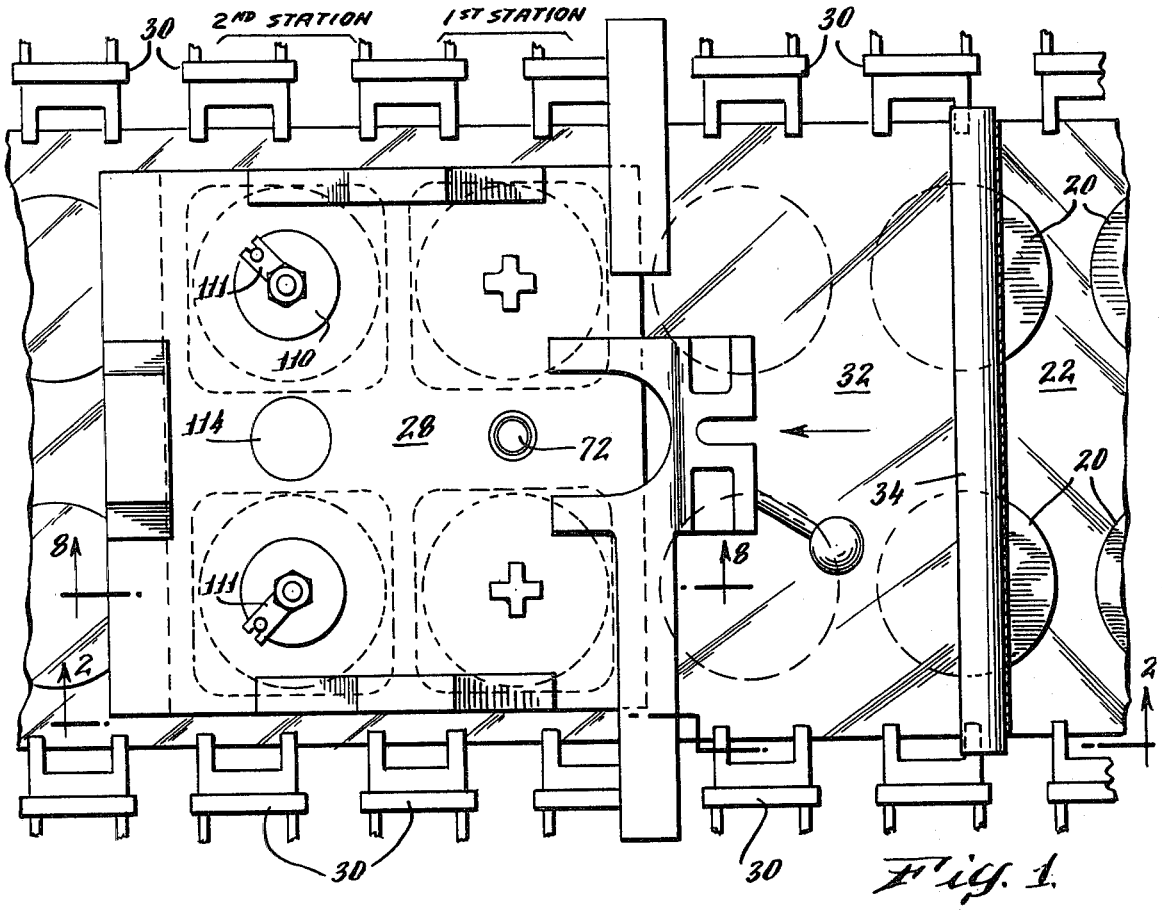
FIG. 1 is a top plan view of packaging apparatus in accordance with this invention wherein product being packaged moves from right-to-left.
Figure 2:
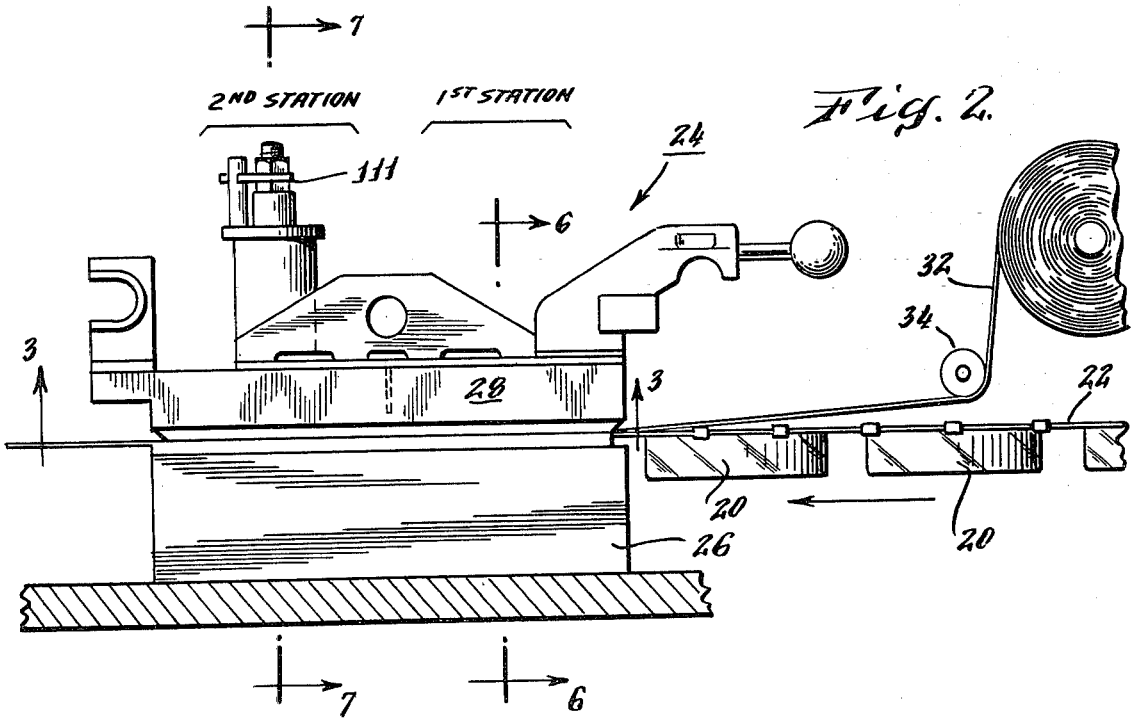
FIG. 2 is a front elevation of the packaging apparatus of FIG. 1.

Referring now to the right-hand portion of FIGS. 1 and 2, a series of product-filled receptacle cups 20, previously formed as side-by-side pairs in a web 22 of semi-rigid plastic film, are advanced from right-to-left in and through a two-station package-forming unit 24. This unit includes a base 26 below the web line, and a packaging head 28 above the web line. The base and head are supported by conventional vertically-movable frames or beds (not fully shown) driven in synchronism to reciprocate the base and head in opposite directions, i.e. to provide an opening and closing movement of those two parts.

The web 22 is carried by an edge-clamp conveyor 30 driven with an intermittent indexing motion in synchronism with the reciprocating movement of the base 26 and head 28. In a cycle of operation, starting from the closed position shown in FIG. 2, the base and head first are reciprocated apart, the cups 20 then are indexed forward one step into their new position between the base and head, and the base and head then are moved back together into closed position as shown, surrounding the enclosed cups. Mechanisms for developing the intermittent indexing movement of the conveyor 30 are well known and thus will not be detailed herein.

Figure 4:
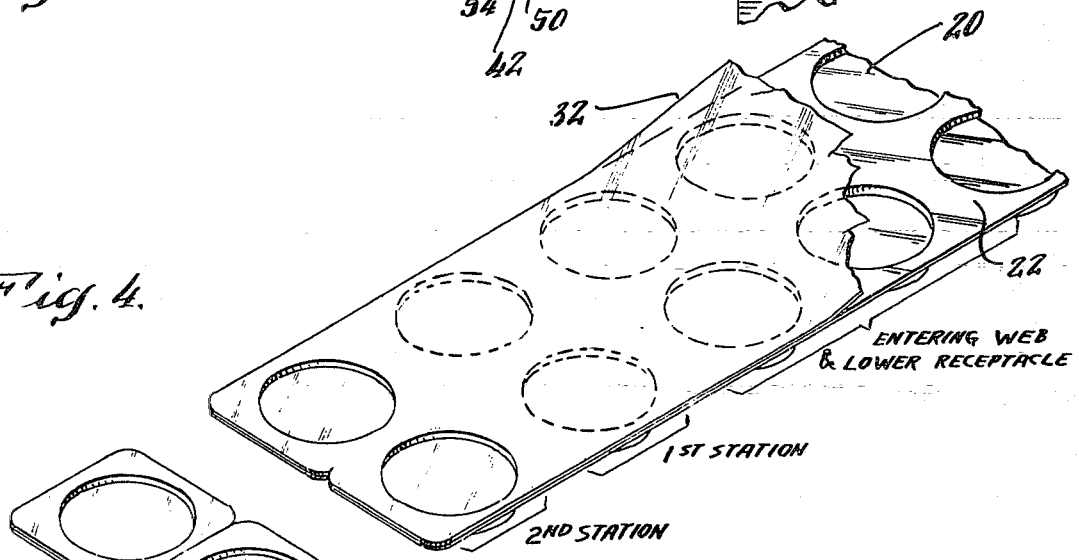
FIG. 4 is a perspective view illustrating the progressive steps of the packaging material as it proceeds through the apparatus in accordance with this invention.
Figure 5:
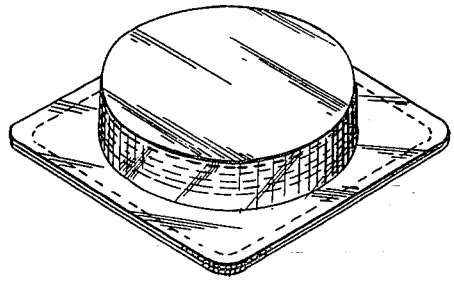
FIG. 5 is a perspective view of a completed package of round luncheon meat as it would be seen by the consumer, i.e. inverted from the way it would actually have passed through the packaging apparatus.

To the right of the package-forming unit 24 an upper web 32 of formable plastic film extends down and around a laydown roll 34 which serves to apply the upper web over the receptacle cups 20 (see also FIG. 4) before the cups enter the package-forming unit. As the upper web moves through the package-forming unit 24, it is sealed to the cups, and formed into closure tops which conform closely to the cup and product configurations. The upper web is drawn from the usual supply roll, and is sufficiently wide to cover both cups of each side-by-side pair, including the side flanges thereof. The upper web 32 in the disclosed embodiment is of semi-rigid (5–15 mil.) heat-formable plastic film with a coating of heat-sensitive peelable sealant compatible with the heat-sealing properties of the cup material. The packaging materials will have predetermined characteristics, such as oxygen barrier, water vapor transmission rate, oxygen scavenging additives, etc., in accordance with the particular product packaging requirements.

Figure 6:
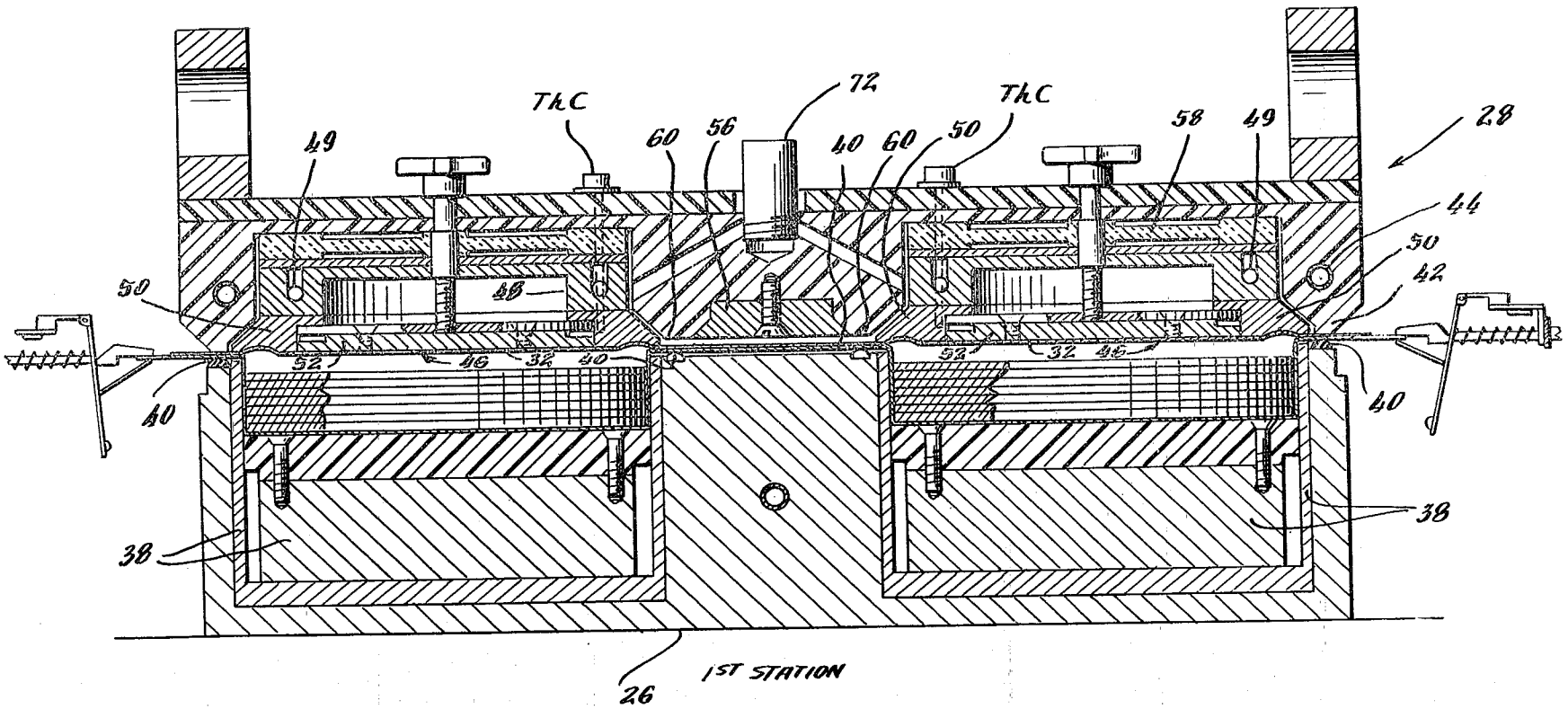
FIG. 6 is a vertical cross-section taken along line 6—6 of FIG. 2 through the first station of the packaging apparatus and showing the first step of two packages being formed simultaneously, side-by-side.

Referring now also to FIG. 6, it will be seen that in the first or "initial seal" station of the package-forming unit 24, the cups 20 are positioned in corresponding sealing die cavities forming part of the base 26. These die cavities include multi-part die fillers 38 shaped to match the cup configuration to provide firm support therefor. Surrounding each die cavity is a temperature-resistant sealing bead 40 which, when the packaging head 28 has moved down to closed position (as shown), is aligned with peripheral heat-sealing bars 42 of the head 28. These bars extend around the three outer flanges of each cup and partially along the fourth flanges in the central region between the two cups. When the head descends into closed position, it presses the top closure film 32 and the cup flanges between the hot seal bars and the sealing bead to effect a seal against air leakage part way around the cup mouth. The sealing bars are supplied with heat by electrical heating rods 44.

Figure 3:
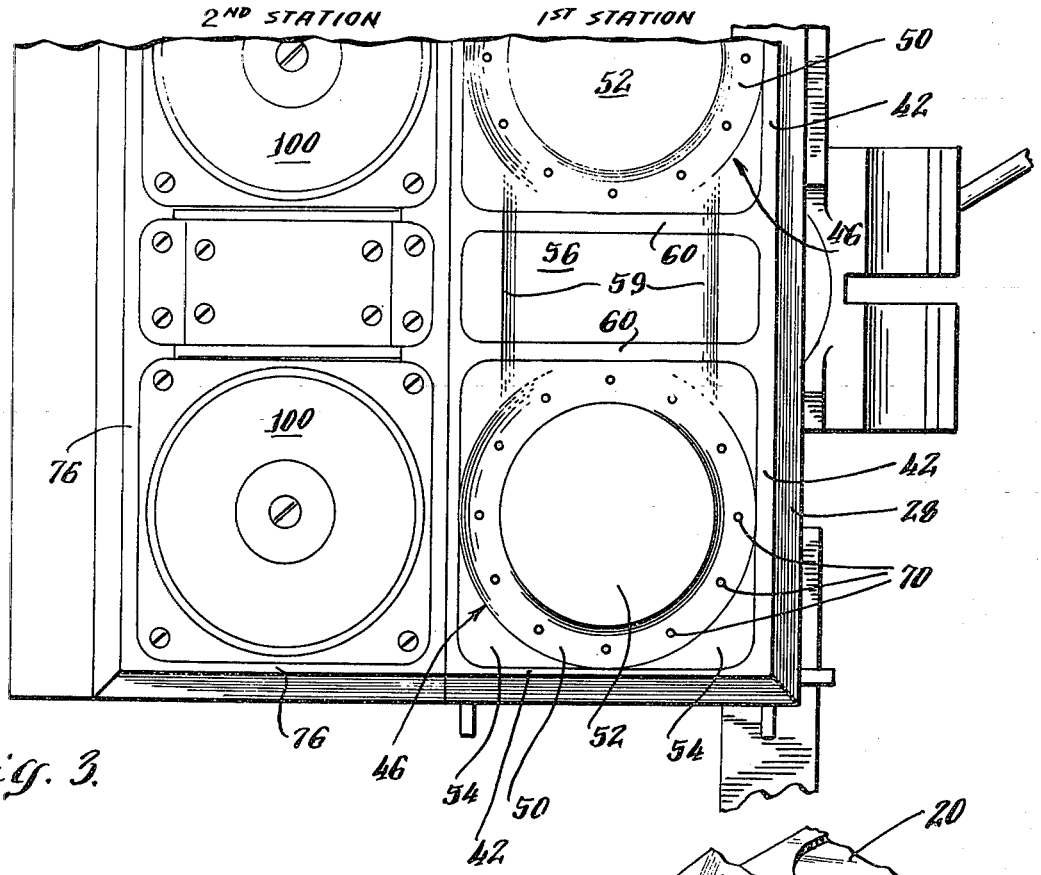
FIG. 3 is a bottom plan view of the two-station packaging head of the machine, i.e. looking upwardly at it from underneath.

After the packaging head 28 has moved down to engage the base 26, vacuum is developed (as will be described) above the upper film 32 to draw that film upwardly and press it against a pair of side-by-side platens 46 (one for each cup 20) which are heated in selected regions by corresponding heating blocks 48. These blocks contain heater elements 49 and are separate from the heaters for the initial-seal bars 42. For round cups 20 to be used for flat product (as shown), this platen is arranged to apply heat only to the regions of the upper web which are just inboard of the corresponding cup walls. Thus, referring now to FIG. 3, each platen 46 is circular in outline, and comprises an outer heated band 50 (preferably formed with a slight concavity as shown in FIG. 6), and a non-heated circular heat-impeding insulator 52.

Non-heated corner insulating members 54 also are positioned in the spaces around each platen 46 to minimize transfer of heat to that part of the film, and to prevent distortion of the film which could result from excessive film movement during the application of vacuum. A central insulating member 56 is positioned between the two platens to prevent softening of the web in that region, so as to assure proper functioning of a web-lifter in the next operating station as will be described. An insulator 58 (FIG. 6) also is positioned between each heating block 48 and the outer parts of the head to permit separate regulation of the temperatures of the heating blocks and the initial heat-sealing bars 42.

On opposite sides of the central insulating member 56 are final-seal-area preheater regions 60 the operating surfaces of which are contoured up a small distance (e.g. 1/16") above the plane of the initial heat-sealing bars 42. The insulator 56 is similarly contoured, as indicated by the break-line 59 on FIG. 3. The sealing bead 40 is interrupted in the area adjacent the preheaters 60 to prevent any inadvertent sealing which might obstruct air flow through this region during the subsequent evacuation of the package in the next station. Such preheating of the final seal area is particularly valuable when making packages with semi-rigid closures; reference may be made to U.S. Pat. No. 3,438,175, where this problem is discussed, and means are described for positively pushing a top closure member against a preheater element by introducing air pressure into the package.

In the embodiment described herein, the top film 32 is moved up against both the preheaters 60 and the platens 46 by developing a vacuum above the top film 32. The achievement of desirably uniform vacuum is aided by the use of small vacuum orifices 70 drilled through the heating platens 46. The vacuum also is applied through the gaps between the platens and adjacent parts such as insulators and the like.

This vacuum is applied to the packaging head 28 through a valve-controlled vacuum port 72. The control valve (not shown) for this port is synchronized with the machine operating cycle in such a fashion that vacuum is applied when the initial heat-sealing bars 42 contact the upper web 32. The vacuum remains on during the "dwell" portion of the indexing cycle, providing for transfer of the proper amount of heat to the upper web 32. The initial seal station then is vented to atmosphere through its vacuum port 72, and the base 26 and head 28 are parted. When the base and head have moved sufficiently far apart, the indexing cycle resumes, and the packages with their top closures now partially sealed to the cup 20, heated sufficiently for forming by the heating platens 46, and preheated in the final seal areas, are transferred to the next successive operating station where forming of the top closures will take place, along with evacuation and final sealing of the packages.

Figure 7:
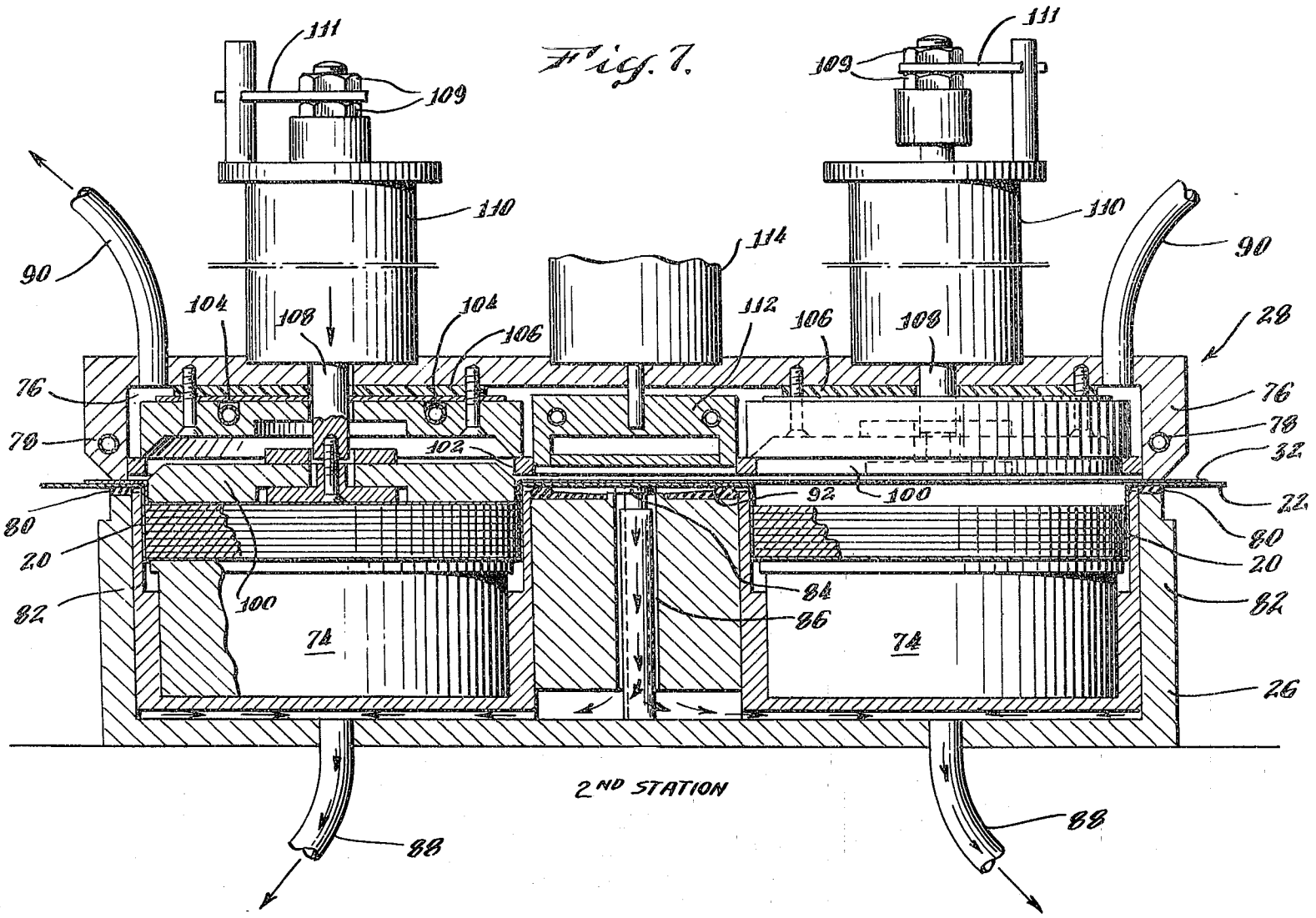
FIG. 7 is a vertical cross-section taken along line 7—7 of FIG. 2 and showing the second station of the packaging apparatus; for convenience in illustration, the two sides of FIG. 7 show different stages of the process carried out in the second station, with the stage on the right preceding that on the left.
Figure 8:
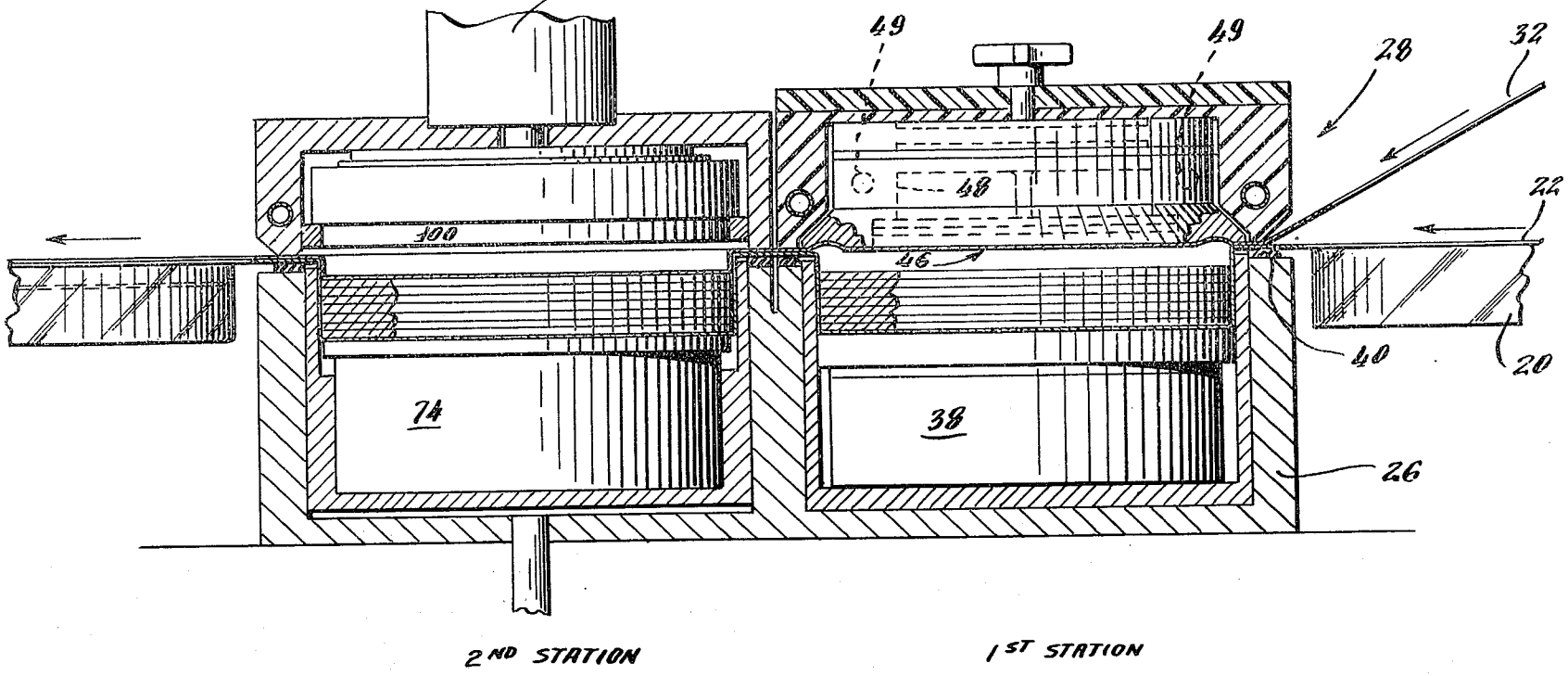
FIG. 8 is a vertical longitudinal section taken along line 8—8 of FIG. 1 through both the first and second stations, showing progression of the product through the packaging apparatus.

Referring now to FIG. 7 showing this final-seal-and-evacuation station with the base 26 and the packaging head 28 closed, the cups 20 again are supported by appropriately shaped multi-part die fillers 74. The base and head serve as clamps to press the packaging material together and to make air-tight sealing engagement with the two webs of packaging material so as to establish upper and lower vacuum chambers surrounding the partially-sealed packages.

The side walls 76 of the packaging head 28 in the final-seal station are cooled by water passages 78 adjacent the horizontal surfaces which press down against the previously heat-sealed regions of the upper film 32. This provides rapid chilling and setting of the heat-activated sealant serving to minimize shifting or separation of the seal as a result of stresses imposed on the seal areas during the subsequent evacuation, forming, final sealing and venting operations yet to come in this station. This chilling of the initial-seal areas is accompanied by squeezing of the package flange seals between the flat horizontal surfaces of the packaging head side walls, and the flat elastomeric sealing surfaces 80 on the upper edge of the mating side walls 82 of the base 26. The seal contours of this elastomeric sealing surface extend a small distance outwardly beyond the initial seal area, i.e. laterally outwards of that seal area. This overall arrangement develops an ironing action to provide the package with a flat undistorted flange superior in appearance and function to packages made by conventional means.

With the base 26 and packaging head 28 in closed position (as shown in FIG. 7), a web-lifter 84 is in known manner driven upwards through a previously-formed evacuation slit in the lower web 12 to engage the lower surface of the upper web 32 and raise that web up a small distance above the lower web. Such displacement of the upper web establishes large-capacity evacuation channels leading from the interior of each cup 20, through the as-yet unsealed region along the interior flanges of each cup, and down through the evacuation slit, the web-lifter bore 86, and the spaces beneath the die fillers 74 to respective conduits 88 coupled to the base 26. A control valve (not shown) for conduits 88 is actuated to apply vacuum to this evacuation channel, and the package evacuation begins.

Simultaneously with the application of vacuum to conduits 88, a separate valve (not shown) is actuated to apply vacuum through a pair of conduits 90 to the upper vacuum chamber, comprising the spaces above the upper web 32. In certain applications, the web-lifter 84 may not be required for establishing the evacuation channel leading to the cups 20, since when the spaces above the web 32 are evacuated, the initial internal air pressure within the package tends to force the upper web up, away from the lower web 22, for at least a portion of the evacuation cycle.

In any event, when the spaces outside of the packages are evacuated, the air pressure initially in the package, i.e. at the start of package evacuation, produces forces on the packaging material pushing it outwardly in all directions. This develops stresses which tend to cause distortion in the package configuration. It has been found to be important, for minimizing such distortion of the cups 20, to support the cups in die-fillers 74 of matched shape. The upper surfaces of these fillers are in the same plane as the elastomeric sealing surface 80 on the base side walls, in order to prevent distortion of the package flanges. This elastomeric sealing surface also is extended at 92 into the evacuation slit region to provide additional support for the flanges in that region. This extended surface tapers slightly downward as it approaches the evacuation slit to assure that the air can flow from within the package without undue restriction during evacuation.

It also has been found to be important to prevent the upper web 32 from moving a significant distance upwards above the web line during this period of positive pressure differential within the package, in order to prevent stretching of the previously-heated film. In the region over the evacuation slit and the web-lifter 84, a flat restraining element 94 is fixed in position to restrict the upward web movement of the closure film. The distance between the film and this restraining element is above 1/16" to allow the web to rise only enough for rapid evacuation and optional gassing of the package interior. This restraining element desirably is formed of heat-insulating material to prevent the upper web 32 from absorbing excess heat from a final seal bar 112, to be described hereinbelow, which is directly over the interior flanges adjacent the final seal areas.

Upward movement of the web 32 also is restricted by the flat surfaces of a pair of vertically movable, top-forming plugs 100 to be described below, and by the flat surfaces of insulating filler inserts 102 surrounding those plugs. (Note: The left-hand plug is shown in its down position, for convenience of illustration, but it will be understood that both plugs move up and down together, and that both plugs are in their upper position as package evacuation begins.) When the plugs are in their upper position, their lower surfaces, and the surfaces of the insulating insert 102, may be within 1/32" of the surface of the upper web 32.

Preferably the elements touched by the upper web 32, as it is forced upwards, are made of heat-insulating material, at least in the regions thereof which are opposite film areas heated in the preceding station, in order to avoid excessive loss of heat from the film so as to maintain the film at formable temperature. For especially long evacuation cycles, or for use with films which require additional heat to maintain a formable temperature, it may be desirable to add a plug heater, such as one utilizing conventional tubular elements illustrated at 104 (shown only for the left hand plug). The plug heaters would transfer heat by conduction to the movable plugs made in this case of a heat-conductive material such as aluminum, and having a high-temperature plastic release coating (e.g. Teflon) on their lower surfaces. Desirably, the plug mechanisms are insulated from the outer chilled surfaces of the head 28 by means of flat insulators 106.

Turning now to the operation of the top-forming plugs 100, when the evacuation of the packages is well underway and approaching completion, the plugs are driven downwardly by the vertically-reciprocable shafts 108 of respective air-operated cylinders 110. These cylinders are controlled by air-valves (not shown) synchronized with the machine operating cycle. The descending motion of the plugs stretches the previously heated, and still soft and formable, top closure film 32 down into each cup 20 and towards the product therein. The downward movement of the plugs 100 also aids in rapid evacuation of the packages.

Satisfactory functioning can be achieved by driving the film 32 down to within a small distance from the top of the product. However, maximum corner definition and elimination of substantial distorting residual stresses in the package are obtained by stretching the film all of the way down to the surface of the product. The stroke depth is adjustable by means of nuts 109 limiting the downward motion, and an antirotation arm 111 also is provided for use with non-round plugs.

Preferably, the plugs are formed with sharply radiused side edges shaped to closely conform to the cup sidewall perimeter, e.g. within 1/32", so that the side walls of the formed tops desirably are in very close proximity to the side walls of the cups. The plug shape may however vary according to the dimensions and special requirements of the package and the product. The plugs thus advantageously are arranged for easy interchangeability as by the use of a simple fastener to hold them in place.

After the plugs have reached the ends of their stroke, and evacuation is complete, a final seal is made in the previously unsealed regions along the adjacent interior cup flanges. This is accomplished by a heated final-seal bar 112 which is driven down by an air-operated actuator 114 to press against the upper web 32 with an appropriate degree of pressure. This seals the two webs together to complete the seal along the entire periphery of the flanges surrounding each cup mouth.

Thereafter, the control valve for the upper conduits 90 is activated to apply air under pressure to the packaging head 28. Thus the spaces above the evacuated packages are pressurized to a level above atmospheric pressure. The downward force of this air pressure, acting in combination with the stretching force of the plugs 100, still held in their lower position, completes the proper forming of each top closure by pressing the still-heated film 32 intimately and tightly down against the surface of the product, so as to follow closely its contour or profile including any pockets or voids. Thereafter, the upper and lower chambers are vented to atmosphere, the base 26 and packaging head 28 are separated, and the packages are indexed out of the packaging head. The completed packages are desirably free from distorting stresses or voids, and the contained products are held immobilized with clear definition of their contours.

The description above relates to the formation of a straight vacuum package. In some cases, it is desired to form a gas package, i.e. a package having a small amount of gas hermetically sealed therein, especially inert gas. The machine described herein can readily make gas packages, with minor changes to the package-forming procedures as set out below.

As in the process for making straight vacuum packages, the upper web 32 first is selectively heated in the initial seal stage as described, and then is transferred to the final seal stage for in-place forming of the tops and completion of the packages. In the final seal stage, the initially-sealed packages are evacuated through the evacuation slit with the aid of the web-lifter 84, and the valve controlling the lower conduits 88 then is shut off. Thereafter a selected gas is supplied through an internal passageway in the web-lifter 84 (in accordance with known techniques) into the package interiors. After a predetermined amount of gas has been admitted, the final seal bar 112 descends from above the web 32 to complete the heat sealing of the packages. As before, this final seal joins the preliminary seal lines to make a complete hermetical seal around the entire periphery of the flanges around the cup mouth.

With the package completely sealed, the plugs 100 descend and press the upper web 32 down towards and against the packaged product, compressing the gas previously admitted to the package and thus increasing its concentration. As the plugs reach the limit of their travel, the upper vacuum chamber is vented, as by means of a three-way valve (not shown) in the conduit lines 90, to connect a regulated source of air pressure to the upper chamber. This inrush of pressurized air above the web 32, which has already been mechanically stretched and somewhat formed by the plugs 100, serves to force the warmed, formable film down into the cups 20, against the side walls of the cups, into any side wall cavities formed in the cups, and down over the product in the cups, around the contours thereof, until the pressure of the gas in the package is equal to the pressure of the air supplied to the upper chamber. At this stage, the top web 32, being held down by the plugs 100, and forced against the product and cup, is chilled as it contacts the product and cup, and holds its form and contours, matching those of the product and other elements against which it has been pressed.

The lower the pressure of the gas introduced into the package relative to the air pressure used to vent the upper chamber, the more closely the top closure film will follow the contours of the product and the cup. The action of the plugs 100, however, in stretching and forcing the top closure film down into the cup is independent of these variables and thus provides a top film formation superior to that obtainable by conventional means. The physical stretching of the interior marginal portions of the top film inwardly around the product and outwardly to the cup 20, especially to a permanent set dimension, is desirable because it tends to eliminate any substantial build-up of tension in the film.

The film is formed to follow the contours of the cup, and the force of atmospheric pressure is carried essentially by the packaged product, aided by the internal gas pressure. This avoids placing portions of the package under heavy stresses, and minimizes distortion of the cup, whether flexible or semi-rigid (as in the preferred embodiment), from its original shape. The plugs 100 remain in their down position during venting of the top chamber, and if the plug face is lightly pressing against the product, this pressing of the top film onto the product will have the added beneficial effect of immobilizing the product without distortion while the product and cup are subjected to the venting pressure forces previously referred to.

After the top film 32 has chilled, the lower chamber is vented to atmosphere, the plugs 100 are retracted, the base 26 and the packaging head 28 separate, and the air pressure to the upper chamber is cut off. The conveyor 30 indexes forward one more step, and the procedures developed are repeated.

It has been found that maximum shaping of closure to product and cup is obtained with a vacuum package as the differential pressures between the package interior and above the closure are maximized. Under these conditions, the heated formable closure film 32, driven by the plugs 100 and acted on by the differential pressure resulting from vacuum in the package and positive air pressure in the upper chamber, will form closely and intimately into and around the contours of the product, and the cup, to produce a package of superior appearance.

One of the important virtues of the packaging apparatus described is its flexible adaptability to a variety of packaging requirements. Probably of most significance in this regard is that the apparatus will produce packages the tops of which are automatically conformed to differing contours or profiles without requiring any changes in the apparatus to accommodate such product variations. This adaptability is a consequence of the fact that the closure top is formed, while still warm, in such a manner that it is shaped by the product, rather than being shaped by a specific, preset die, or the like, designed to approximate an average product contour. This advantage of the invention is not best demonstrated by the illustrated package of sliced bologna, since the top surfaces of bologna are relatively smooth, but would be better exemplified by the packaging of irregular products.

In addition, the described apparatus can readily be altered, by relatively simple change-over of parts, to shift from the packaging of one type of product to a quite different product. This is illustrated for example by FIG. 9 which is comparable to FIG. 7 but shows the final seal stage arranged for packaging frankfurters rather than bologna.

Figure 9:
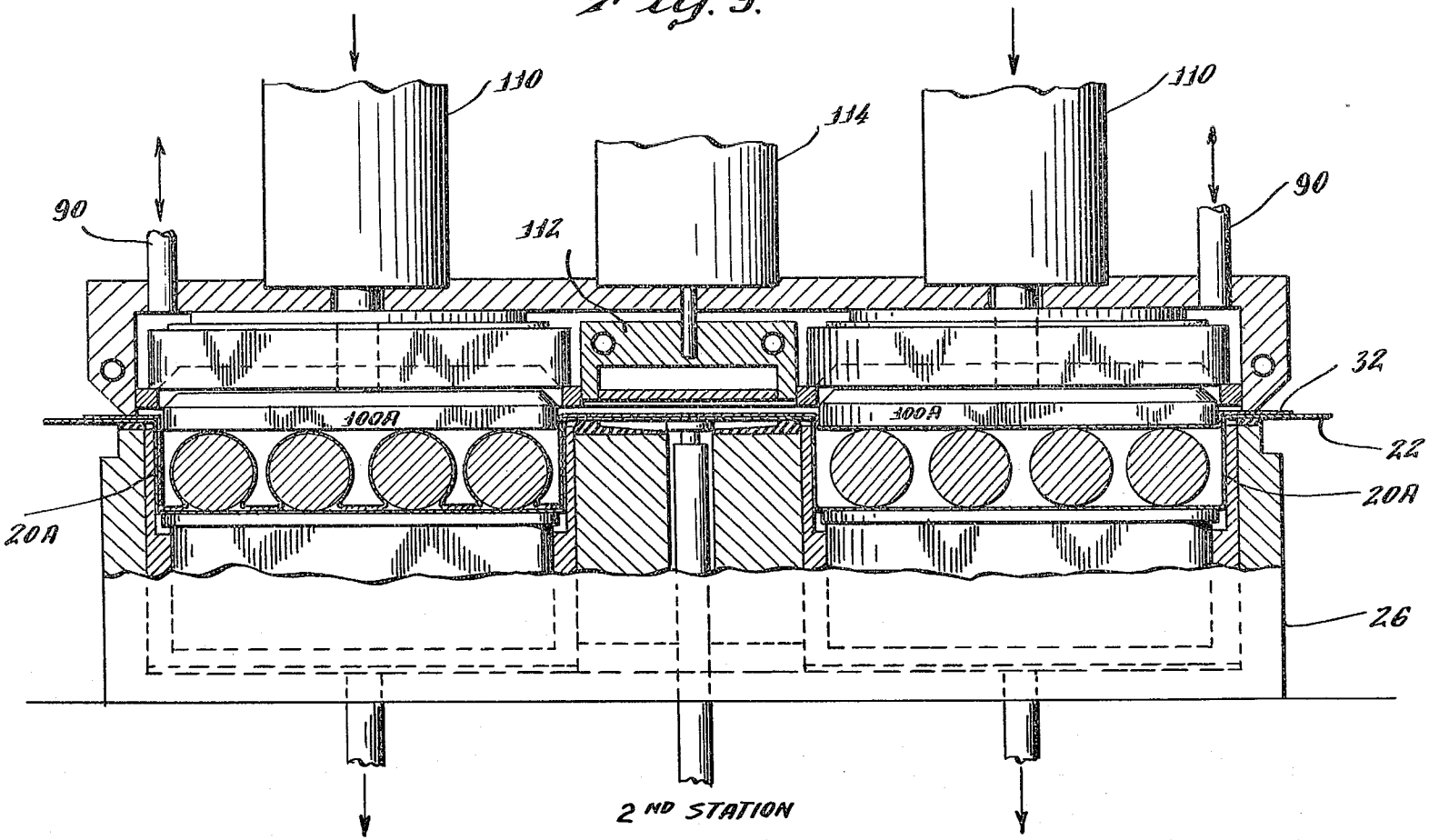
FIG. 9 is a section corresponding to FIG. 7 but showing the packaging apparatus being used for the packaging of frankfurters, and with both plugs in the down position.

In the modified machine of FIG. 9, the plugs 100A have a rectangular plan configuration matching the shape of a rectangular cup 20A carrying the frankfurters. In the corresponding initial seal stage (not shown), the upper web 32 is selectively heated throughout a rectangular area opposite the rectangular mouth of the cup, to soften that entire region of the upper web for forming in the final seal stage.

The procedures followed in the final stage are like those previously described. The package evacuation first is initiated, and shortly thereafter the plugs 100A are driven down to stretch the heated rectangular film area substantially to the upper surfaces of the frankfurters. Final sealing of the package then takes place, after which the upper vacuum chamber is vented to positive pressure, i.e. above atmospheric, while the plugs remain down and vacuum is maintained in the lower chamber. The positive pressure forces the still-heated film down around the side of the frankfurters (as illustrated in the left-hand unit), to follow the contours thereof closely. The resulting package thereby presents a sharply defined, rigidly immobilized product, without distortion, and clearly visible to a prospective customer.

Figure 10:
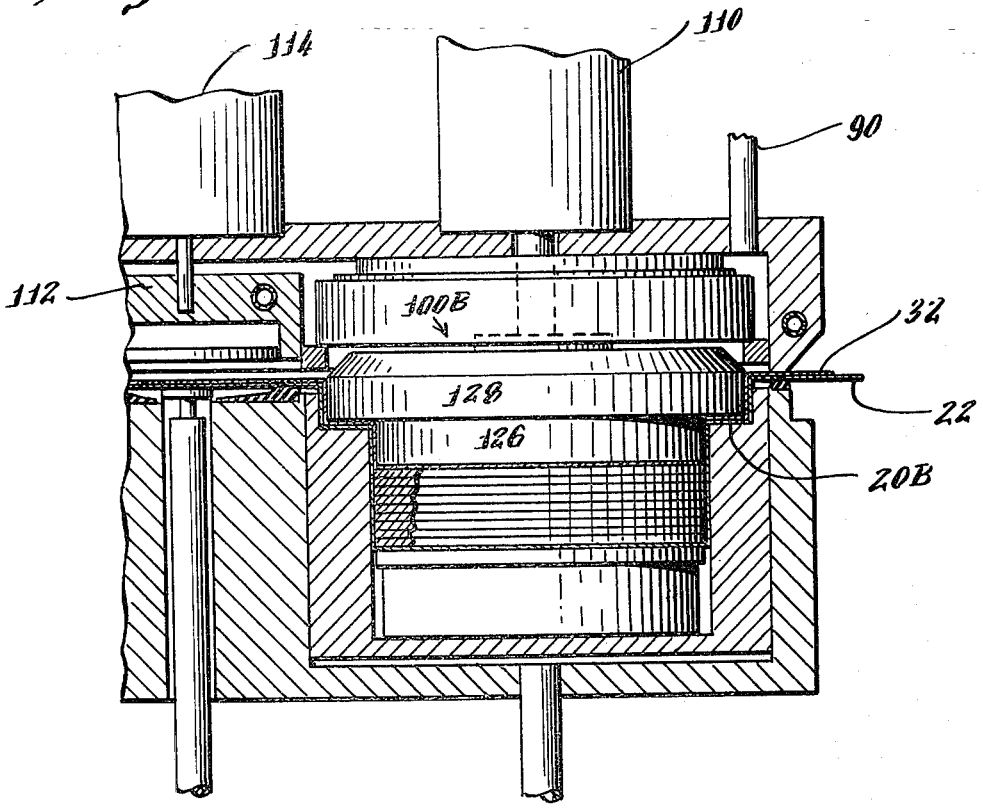
FIG. 10 is a detail vertical cross-section of a part of the second station showing a modification whereby the package may be given an elevated base to better display its contents.
Figure 11:
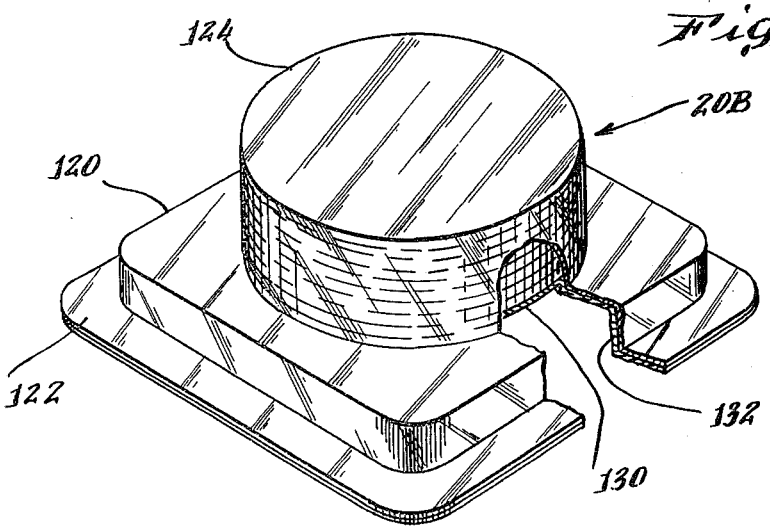
FIG. 11 is a perspective view of the package which has been formed in the modification of FIG. 10, inverted from the way the package is shown in FIG. 10.

FIGS. 10 and 11 illustrate the formation of still another type of package, wherein round bologna is held in a specially-shaped receptacle 20B providing a square platform or pedestal 120 between the package flanges 122 and the round product-containing portion 124. To develop this two-level configuration, the top-forming plugs 100B are shaped in a stepped arrangement, comprising a lower round portion 126 to match and fit within the round section of the receptacle, and an upper square portion 128 to match and fit within the corresponding square pedestal section of the receptacle. As in the previous embodiments, these plugs are driven down against the selectively-heated upper web 32 and serve, especially in conjunction with the pressure differential from the subsequent venting of the upper chamber, to form the closure top in such a way that, as shown in FIG. 11, it provides a round section 130 and a square section 132 precisely matching the receptacle shape and product configuration. Also, as in the FIG. 6 arrangement, the pre-heating platens in the initial seal stage will be so constructed as to selectively heat particularly those regions of the upper web which are to be stretch-formed in the final seal stage, so as to produce the package as shown.

It will be understood from the above description of preferred embodiments of the invention that apparatus following the teachings of this invention is especially adapted to afford flexible and versatile operation in producing excellent packages for products of various shapes and configurations. The invention finds special applicability for use with products of irregular shape, since with the unique top-forming procedures described, the product itself controls the contour of the top closure. Thus, even though the product profile changes from unit to unit as they enter the machine, each closure top will automatically be conformed to its corresponding product.

The apparatus also has the capability of making packages from a variety of different packaging materials, including flexible and semi-rigid packaging material, plastic or otherwise, whether used for the receptacle cup (lower web) or the closure top (upper web). The versatility of the apparatus is still further enhanced by the ready interchangeability of the basic operating components so as to suit different types of products and/or package configurations. Such changeover in the preferred embodiments disclosed does not require substitution of a complete series of receptacle-supporting trays, since both webs of packaging material are supported by an edge-clamp conveyor adaptable to all kinds of packages. Also, although an intermittently-indexed conveyor is shown, it will be appreciated that continuous-motion operation can be used, in accordance with well-known techniques.

Accordingly, although specific preferred embodiments of the invention have been described in detail hereinabove, it is desired to emphasize that this is for the purpose of illustrating the principles of the invention, and should not necessarily be construed as being limiting of the invention since it is apparent that those skilled in this art can make many modified arrangements of the disclosed apparatus without departing from the true scope of the invention.

We claim:

1. Packaging apparatus for making packages of the type having a receptacle cup of packaging material formed with flanges around the mouth thereof, and a top closure of packaging material sealed to said flanges; said apparatus comprising:

first and second packaging stations;

conveyor means for carrying a series of flanged cups through said first and second stations;

means to supply a web of packaging material over said cups before they enter said first station;

initial seal means at said first station for heat-sealing said web to the cup flanges at least substantially around the mouth thereof;

evacuating and final seal means at said second station comprising upper and lower members which are relatively reciprocable into a closed position surrounding a receptacle cup and a portion of said web heat-sealed thereto, said upper and lower members defining a sealed chamber for evacuating the interior of the cup;

said upper and lower members comprising vertical wall means with engageable mating flat surfaces serving in said closed position as clamp means to grip the flange regions of a receptacle cup within said chamber and press them against said web;

said mating surfaces being stationary relative to the receptacle cup and comprising means to squeeze together and tightly compress the facing portions of packaging material at said flange regions to effect a smoothing of the surface of the packaging material while the receptacle cup is stationary relative to said second station;

at least one of said wall means being formed with internal passages close to the corresponding mating surface thereof and arranged to carry cooling water to remove heat from said flange regions while they are held tightly compressed together in smoothed condition by said flat mating surfaces, said water-cooled surface chilling the parts of said flange regions which were heat-sealed in said first station so as to effect setting of the seal thereof while the material is in compressed smoothed condition, whereby to produce a package with a superior flat undistorted flange.

2. Apparatus as claimed in claim 1, wherein said mating surface on said lower member comprises a flat element of elastomeric material having a horizontal dimension sufficient to extend out laterally beyond the initial seal region produced at said first station;

said water-cooling passages being formed in said upper member.

3. Apparatus as claimed in claim 2, wherein said lower member includes in its interior a die-filler having a shape matching that of the receptacle cup so as to receive and support the cup;

said die-filler having a portion underlying a part of the cup flange, interiorly of said flat elastomeric element, with the upper surface of said underlying portion being in the same plane as said elastomeric element.

* * * * *